United States Patent [19]

Lemke

[11] Patent Number: 4,896,583

[45] Date of Patent: Jan. 30, 1990

[54] SADDLE BEARING SUPPORT FOR AXIAL PISTON PUMPS AND MOTORS

[75] Inventor: Gregory D. Lemke, Union Grove, Wis.

[73] Assignee: Racine Fluid Power Inc., Broadview, Ill.

[21] Appl. No.: 159,864

[22] Filed: Feb. 19, 1988

[51] Int. Cl.[4] ..... F04B 1/30

[52] U.S. Cl. ..... 91/505; 92/12.2

[58] Field of Search ..... 92/12.2; 91/504–506

[56] References Cited

U.S. PATENT DOCUMENTS

| | | | |
|---|---|---|---|
| 2,601,830 | 7/1952 | Berlyn | 91/505 |
| 2,737,895 | 3/1956 | Ferris | 92/12.2 |
| 2,963,983 | 12/1960 | Wiggermann | 91/505 |
| 3,124,008 | 3/1964 | Firth et al. | 74/60 |
| 3,868,889 | 3/1975 | Bobier | 91/506 |
| 4,167,895 | 9/1979 | Rubinstein | 91/506 |
| 4,627,330 | 12/1986 | Beck | 92/12.2 |

FOREIGN PATENT DOCUMENTS

| | | | |
|---|---|---|---|
| 155487 | 9/1985 | European Pat. Off. | 91/506 |
| 628472 | 3/1936 | Fed. Rep. of Germany | 92/12.2 |
| 833347 | 7/1943 | France | 91/505 |
| 1073216 | 6/1967 | United Kingdom | 91/506 |

OTHER PUBLICATIONS

Interim Bulletin IB13, Dec. 1978, published by Racine Fluid Power Products Division.

*Primary Examiner*—Leonard E. Smith

*Attorney, Agent, or Firm*—Marshall & Melhorn

[57] ABSTRACT

In a multiple piston axial type pump, a support saddle and cooperating swash block are enclosed by a housing. A pair of arcuate bearing shells are attached to spaced apart bearing seats formed on the swash block. The bearing shells contact load bearing surfaces on the support saddle. The length of each of the bearing shells is less than the length of the support saddle load bearing surfaces so that the facing surfaces of the bearing shells are always in complete contact with the load bearing surfaces throughout the complete range of relative positions of the support saddle and the swash block.

8 Claims, 3 Drawing Sheets

SADDLE BEARING SUPPORT FOR AXIAL PISTON PUMPS AND MOTORS

BACKGROUND OF THE INVENTION

The invention relates to bearing supports in general and to saddle bearing supports for use in multiple piston, axial type pumps and motors in particular.

The use of multiple piston axial type pumps/motors is widely known. The axial pumps are used for pumping liquid at high pressures, the liquid usually being employed to energize hydraulic systems. The pumps include a rotating cylinder barrel or block in which cylinders and cooperating pistons are arranged. The pistons draw the liquid into the pump and then force the liquid back out at high pressures. Axial piston motors are actuated by high pressure liquid to reciprocate the pistons and rotate the cylinder block producing rotary motion at an output shaft.

In many prior art axial type pumps and motors, a casing encloses the operating mechanism. A drive/output shaft extends through the casing and is rotatably supported by a plurality of bearings. A cylinder block is coupled at one end of the shaft and has a plurality of cylinders formed in a circular row concentric with the shaft. Each cylinder is fitted with a piston which is in contact with a non-rotating swash block. The swash block is rockably supported upon stationary spherical bearing surface. The swash block can be inclined from a neutral position with respect to the saddle to impart reciprocating movement to the pistons.

One of the problems that exists with the prior art axial pumps and motors is the bearing support design employed in the area of the swash block and the saddle. The current art uses a concavo-convex liner or thrust bearing which is seated on either the swash block or the saddle and extends across the full surface of the associated element. As the position or angle of the swash block is changed in order to impart a reciprocating motion to the pistons, a thrust load is applied to the bearing. Thus, an edge loading problem exists where the edge of the element not attached to the bearing contacts the bearing surface. This edge loading causes flex and early fatigue of the bearing.

It is an object of the present invention to provide a bearing support that will eliminate edge loading.

It is a further object of the present invention to provide a bearing support system for an axial pump/motor which will increase bearing life and maintain the bearing under a constant load distribution.

SUMMARY OF THE INVENTION

The present invention relates to a saddle bearing support system for use at the contact surface of a swash block with a support saddle in axial piston pumps and motors. In an axial pump, an external power source, such as an electric motor, rotates a shaft coupled to a cylinder barrel and sleeve assembly containing the pumping pistons and cylinders. The pumping pistons are attached at one end to swiveling shoes which are held in contact with a swash block by a spring loaded ball joint. The swash block is configured with two arcuate load carrying surfaces to which are attached bearing shells. The swash block is seated on a saddle having a cooperating bearing surface.

The position of the swash block determines the stroke of the pistons and thus the amount of flow through the axial pump, and is determined by a mechanically engaged control linkage. When the control linkage swivels the swash block, the face of the swash block is inclined with respect to an opposed face of the cylinder barrel. Therefore, as the pistons revolve around the face of the swash block, a reciprocating motion is imparted to them. As each piston moves through one half of a revolution of the cylinder barrel, its cylinder bore is open to a first crescent formed in a valve plate. Each piston moves outward during that part of the revolution, thereby displacing fluid through the crescent from its bore. When the piston reaches its outermost stroke, its bore is blocked by having passed by the crescent port opening. Moving through the other half of the revolution of the cylinder barrel causes each piston bore to open to a second crescent port in the valve plate. As each piston strokes inwardly during the other half of the revolution, it draws fluid through the second crescent port to fill the bore until the piston bore has passed the second crescent port and is blocked once more.

The amount of piston displacement is determined by the degree of the swash block angle and therefore determines the amount of delivery from the pump. As the swash block angle is changed through mechanical displacement by the control linkage, the load bearing surfaces of the swash block slide against the load bearing surfaces of the saddle. In accordance with the present invention, a pair of bearing shells are attached to the swash block load bearing surfaces, and as such move along with the swash block when it is displaced. The bearing shells provide the load carrying means for the pressure applied by the swash block against the saddle. The arcuate length of the bearing shells is such that the entire bearing surface is always in contact with the load bearing surfaces of the saddle. Of course, the above described mechanism can be operated as a motor by applying pressured fluid to the pistons and coupling a load to the rotating shaft.

Unlike the prior art, and in accordance with the present invention, the entire bearing is under load, rather than exposing the bearing to a repeated loaded/unloaded condition. The present invention also allows the use of a smaller and less complicated baring than those which are currently used in axial pumps and motors. The present invention also enhances pump/motor serviceability by providing ease of assembly.

BRIEF DESCRIPTION OF THE DRAWINGS

The above objects and advantages of the invention will become manifest to one skilled in the art from considering the following detailed description of an embodiment of the invention in light of the accompanying drawings in which.

DESCRIPTION OF THE PREFERRED EMBODIMENT

Figure 1:
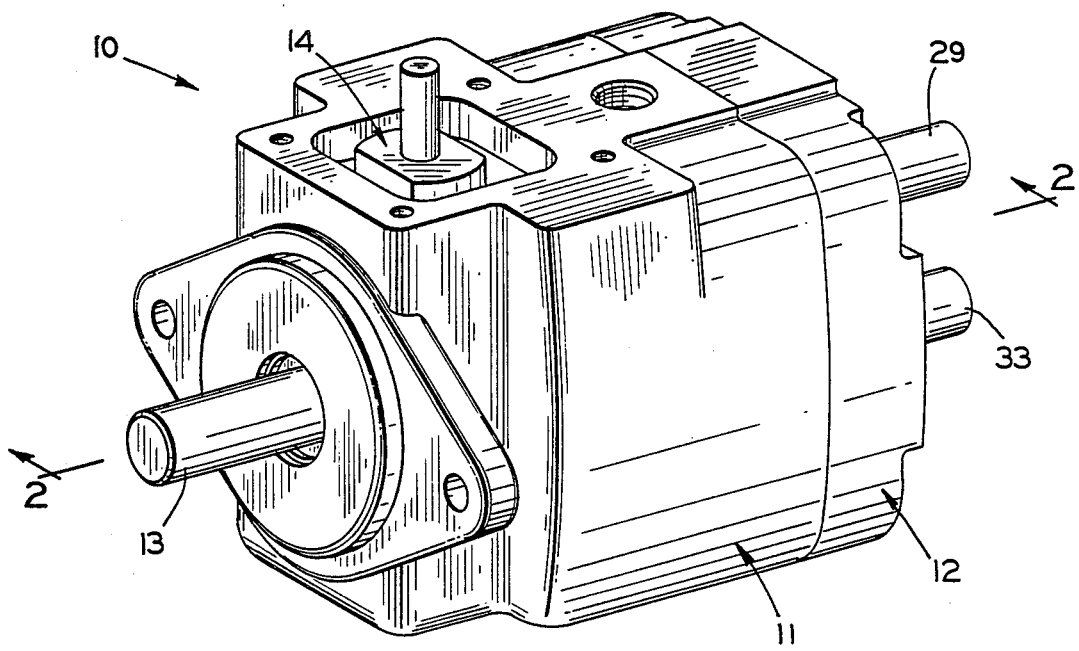
FIG. 1 is a perspective view of an axial pump incorporating the present invention.

Turning now to the drawings, there is illustrated in FIG. 1 a multiple piston axial type pump 10 in which the present invention is incorporated. The axial pump 10 is comprised of a pump housing 11 with a valve plate assembly 12 attached at one end, a drive shaft 13 extending from an opposite end, and a control linkage 14 extending through an upper side wall.

Figure 2:
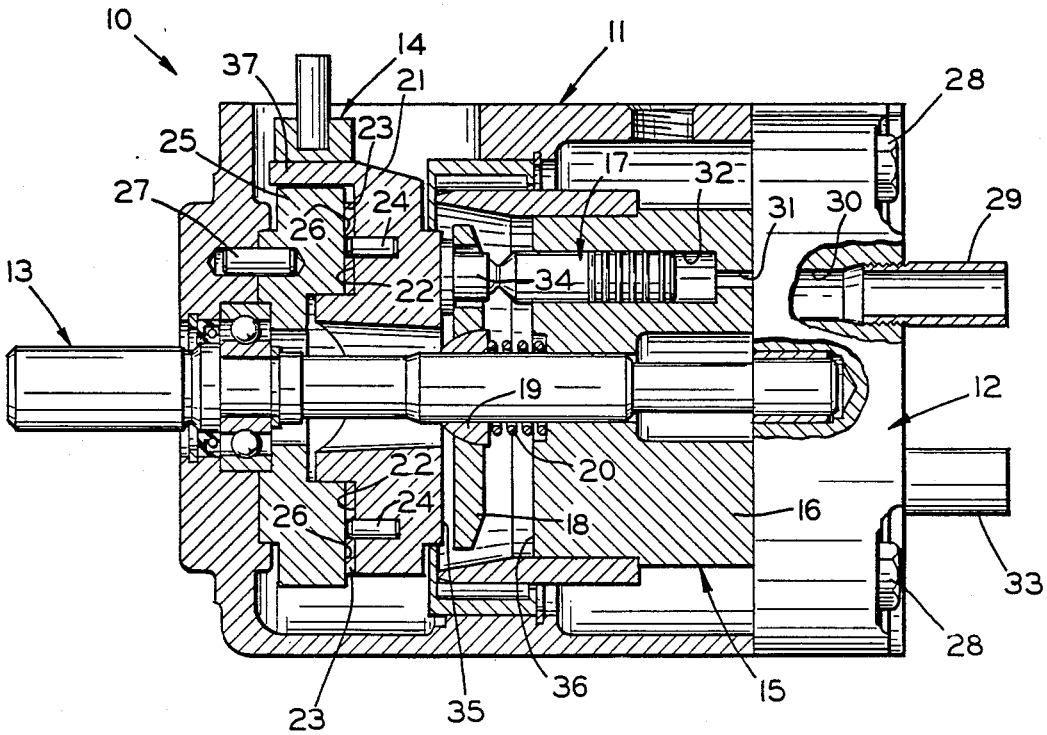
FIG. 2 is a sectional view of the axial pump illustrated in FIG. 1 taken along line 2—2.

As shown in FIG. 2, a rotating assembly 15 is attached to the drive shaft 13 inside the housing 11. the rotating assembly 15 consists of a cylinder barrel 16 attached to the drive shaft 13 for rotation, a plurality of piston and shoe subassemblies 17 (only one is shown) extending into the barrel 16 and attached to a shoe retainer 18, and a retainer ball 19 and a spring 20 mounted on the drive shaft 13. The retainer ball 19 extends through the center of the retainer 18 and the spring 20 is seated on the barrel 16 to bias the ball 19 and the retainer 18.

The pump 10 further encloses a swash block 21 having bearing seats 22 on which are seated a pair of bearing shells 23 which are retained thereto by spring pins 24. The swash block 21 is seated in a saddle 25 and slides across load carrying surfaces 26 of the saddle. The saddle 25 is rigidly mounted to the inside of the pump housing 11 by means of one or more locating dowels 27.

The valve plate assembly 12 can be attached to the pump housing 11 by any suitable means such as a pair of threaded fasteners 28. A fluid inlet connector 29, for use in connecting the pump 10 to a source of fluid, is threadably retained in an inlet aperture 30 formed in an upper portion of the valve plate body. The aperture 30 typically is crescent shaped adjacent an aperture 31 formed in the cylinder barrel 16 and is in fluid communication with a cylinder 32 formed in the barrel 16. The cylinder 32 cooperates with the piston of the piston and shoe subassembly 17. A fluid outlet connector 33 is retained in a lower portion of the valve plate body in a manner similar to the inlet connector 29. An associated inlet aperture, similar to the aperture 30, is not shown but is in fluid communication with the aperture 31 when the barrel 16 is rotated into the lower portion of the pump housing 11.

When in use, the axial pump 10 is powered by a suitable drive means, such as an electric motor, for example, which is attached to the drive shaft 13 by any suitable coupling. The drive means rotates the drive shaft 13 which turns the rotating assembly 15 including the piston and shoe subassemblies 17. The spring 20 applies pressure against the retainer ball 19 and the shoe retainer 18 to hold a piston shoe 34, attached to an end of the subassembly 17, against the swash block 21.

When the control linkage 14 is at a "neutral" position, the swash block 21 is centered, the swash block angle is zero and a face 35 of the swash block is parallel to and adjacent end face 36 of the cylinder barrel 16. At the "neutral" position of the control linkage 14, there is no inward or outward travel of the pistons in the associated cylinders as the associated shoes rotate around the face 35 of the swash block 21 and therefore, no fluid is displaced between the cylinder bore 32 and the valve plate assembly 12.

The control linkage 14 engages a projection 37 extending from the swash block 21. When the control linkage 14 swivels the swash block 21, the face 35 is no longer parallel to the face 36 of the cylinder barrel 16.

Figure 3:
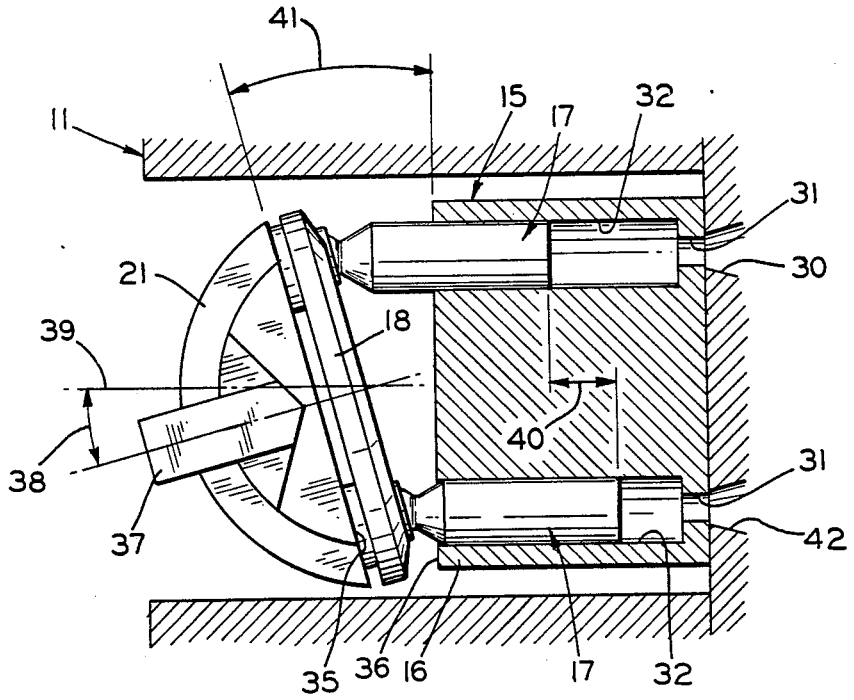
FIG. 3 is a fragmentary cross-sectional schematic view of the pistons and swash block of the axial pump illustrated in FIG. 1.

As shown in FIG. 3, an angle 38 of inclination of the retainer 18 and the swash block 21 with respect to a longitudinal axis 39 of the rotating assembly 15 determines the length of a stroke 40 of the piston and shoe subassemblies 17. In this position, the face 35 is at an angle 41 with respect to the adjacent end face 36 and a reciprocating motion is imparted to the pistons as the shoes 34 revolve about the face 35 of the swash block 21. Typically, the angle 38 can be approximately twenty-two degrees on either side of the axis 39.

As each cylinder moves through the lower half revolution of the cylinder barrel 16, its bore is open to a lower crescent shaped outlet aperture 42 formed in the valve plate assembly 12. Each piston moves outwardly during the lower half revolution, displacing fluid through the lower crescent shaped aperture 42 until it reaches its outmost stroke. When a piston reaches its outmost stroke, its cylinder opening 31 is blocked since the cylinder barrel 16 has rotated the associated opening 31 past the lower crescent shaped aperture 42.

As each piston moves through the upper half revolution of the cylinder barrel 16, the associated cylinder bore 32 opens to the upper crescent shaped aperture 30 in the valve plate assembly 12. During the upper half of the revolution of the cylinder barrel 16, each piston strokes inwardly and draws fluid through the upper crescent shaped aperture 30 into the cylinder bore. When the piston reaches its innermost position, the associated opening 31, having passed the upper crescent shaped aperture 30, is blocked once more before beginning the lower half revolution again.

As illustrated in FIG. 3, the degree of the swash block angle 38 determines the length of the piston stroke 40 and therefore determine the amount of delivery from the axial pump 10. As the delivery rate increases due to an increased piston stroke 40, there is also an increase in the discharge pressure from the pump 10 with constant circuit resistance. The increased discharge pressure results in additional load on the bearings 23 which support the swash block 21 on the saddle 25.

Figure 4:
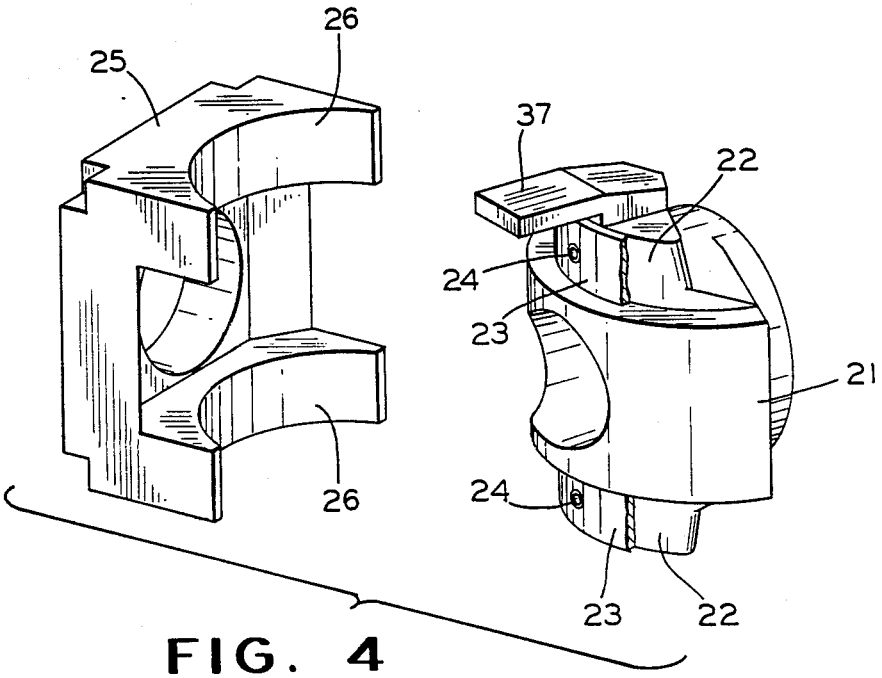
FIG. 4 is an exploded perspective view of a swash block and saddle of the axial pump illustrated in FIG. 1.

In accordance with the present invention, the attachment of the bearing shells 23 to the load carrying surfaces 22 of the swash block 21 provides a support bearing system which eliminates edge loading of the bearings. As shown in FIG. 4, the bearing shells 23 are attached to the surfaces or seats 22. The arcuate length of the baring shell 23 is substantially less than the length of the abutting load bearing surface 26 on the saddle 25. The arcuate length of the bearing shell 23 is selected to avoid contact between the bearing shell surface and the edges of the surface 26 at either extremity of the path of travel of the swash block 21. By allowing the bearing shells 23 to move with the swash shells through the swash block 21 is always spread across the entire baring surface and no edge load is applied to the bearing shells 23.

Figure 6:
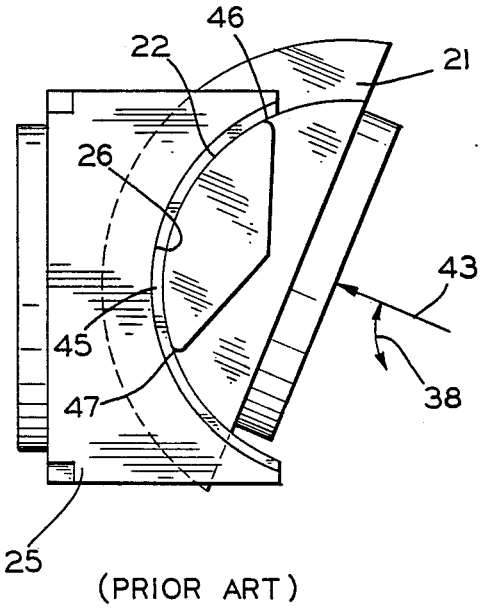
(PRIOR ART) FIG. 6
FIG. 6 is a front elevation view of a swash block and saddle of a prior art axial pump.

In one prior art device shown in FIG. 6, a bearing shell 45 is attached to the saddle 25 on the surface 26, and the bearing surface 22 of the swash block 21 slides across the face of the bearing shell 45. Thus, substantial edge loads are created on the bearing shell 45 at ends 46 and 47 of the bearing surface 22. The ends 46 and 47 tend to push the bearing material ahead of the movement of the swash block, thereby exposing the bearing shell 45 to galling and a repeated loaded/unloaded condition. The edge loading also increases the potential for distortion thereby creating a gap between the bearing shell and the saddle resulting in bearing flex and fatigue of the bearing.

Figure 7:
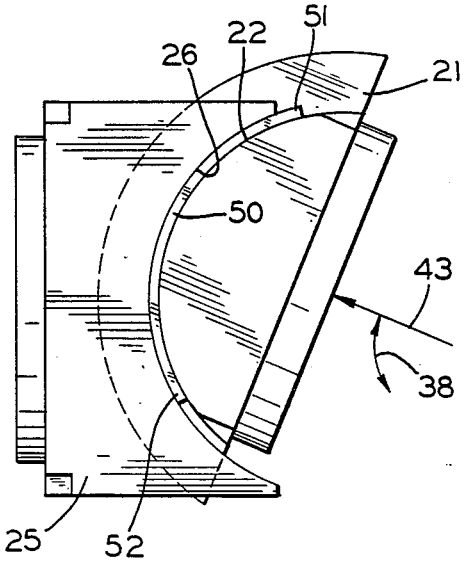
(PRIOR ART) FIG. 7
FIG. 7 is a front elevation view of a swash block and saddle of another prior art axial pump.

Another prior art device is shown in FIG. 7 where a bearing shell 50 is attached to the bearing surface 22 of the swash block 21. The arcuate length of the bearing 50 approximately the same as the length of the bearing surface 26 on the saddle 25. Thus, edges 51 and 52 of the bearing 50 come into contact with the surface 26 and cause edge loading.

Figure 5:
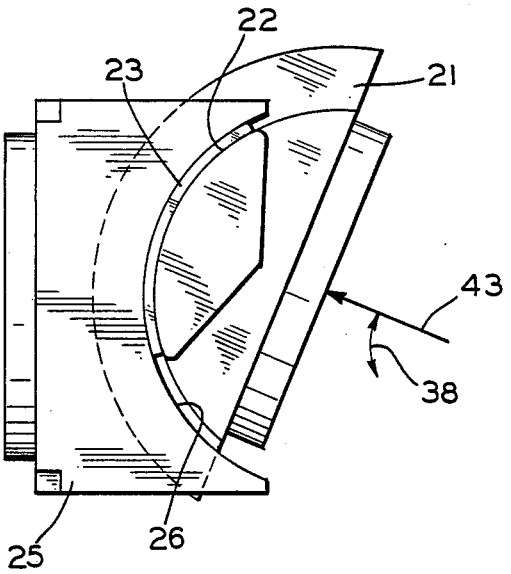
FIG. 5 is a front elevation view of the swash block and saddle of FIG. 4 is assembled relation.

The potential for bearing failure increases as the angle 38 of the swash block 21 increases, due to the angle being proportional to the output flow and pressure generated in the pump. As illustrated in FIG. 5, the resultant load 43 is spread over the entire surface of the bearing 23 in accordance with the present invention. The arcuate length of the bearing 23 is selected to maintain the entire bearing surface in contact with the saddle load carrying surface throughout the range of angles of the swash block relative to the saddle. In contrast, as illustrated in FIG. 6 and in FIG. 7, the resultant load is distributed over less than all of the surface of the bearings 45 and 50 and creates edge loading. This partial loading of the bearing causes bearing failures or reduces bearing fatigue life.

The present invention eliminates the drawbacks experienced by the prior art pumps, by preventing edge loading of the bearing. The uniform loading prevents gap and flexing of the bearing and further prevents galling as the swash block moves across the saddle.

In accordance with the provisions of the patent statues, the present invention has been described in what is considered to represent its preferred embodiment. However, it should be noted that the invention can be practiced otherwise than as specifically illustrated and described without departing from its spirit or scope.

What is claimed is:

1. A thrust bearing support for an axial piston pump having a support saddle comprising:

a swash block having at least one arcuate bearing seat;

an arcuate bearing shell attached to said bearing seat of said swash block and having an arcuate length of a bearing surface less than a length of an associated bearing surface of a support saddle; and means for retaining said bearing shell on said bearing seat of said swash block.

2. A thrust bearing support according to claim 1 wherein said means for retaining said bearing shell is a pin attached to said swash block and to said bearing shell.

3. A thrust bearing support according to claim 1 wherein said bearing shell bearing surface has an arcuate length which ensures said bearing shell bearing surface is in complete contact with an associated bearing surface of a saddle throughout a predetermined range of relative angular positions between said swash block and the saddle.

4. A thrust bearing support according to claim 1 wherein said swash block has a pair of said bearing shells attached to a pair of spaced apart bearing seats.

5. An axial piston pump for pumping fluid comprising:

a housing;

a support saddle mounted inside said housing and having a pair of spaced apart load bearing surfaces;

a swash block mounted inside said housing adjacent said support saddle and having a pair of bearing seats; and a pair of arcuate bearing shells each attached to an associated one of said swash block bearing seats for contact with an associated one of said support saddle load bearing surfaces, each of said bearing shells having an arcuate length less than an arcuate length of said associated one of said support saddle load bearing surfaces.

6. An axial piston pump according to claim 5 wherein each of said bearing shells is attached to said swash block by a pin.

7. An axial piston pump according to claim 5 including a control linkage coupled to said swash block for angularly positioning said bearing shells along said support saddle load bearing surfaces.

8. An axial piston pump for pumping fluid comprising:

a housing;

a support saddle mounted inside said housing and having at least one arcuate load bearing surface;

a swash block mounted inside said housing adjacent said support saddle and having at least one arcuate bearing seat;

an arcuate bearing shell attached to said bearing seat and having an arcuate bearing surface in contact with said load bearing surface, said arcuate bearing surface having an arcuate length less than an arcuate length of said load bearing surface; and means for moving said swash block relative to said support saddle whereby said arcuate bearing surface remains in complete contact with said load bearing surface in all relative positions of said swash block and said support saddle.

* * * * *